United States Patent [19]

Michalik et al.

[11] Patent Number: 4,964,471

[45] Date of Patent: Oct. 23, 1990

[54] SPRINKLER SYSTEM AND SPRINKLER ASSEMBLY THEREFOR

[75] Inventors: Leo K. Michalik, Fruitvale; Segio G. Mussio, Trail, both of Canada

[73] Assignee: Cominco Ltd., Vancouver, Canada

[21] Appl. No.: 401,882

[22] Filed: Sep. 1, 1989

[51] Int. Cl.[5] ..... A62C 37/11; A62C 37/08

[52] U.S. Cl. ..... 169/57; 169/54; 169/37; 169/41; 285/189; 285/368; 285/239; 239/518; 239/600

[58] Field of Search ..... 169/57, 56, 54, 37, 169/41, 42, 17, 19, 26; 239/519, 518, 600; 285/189, 368, 239

[56] References Cited

U.S. PATENT DOCUMENTS

| | | | |
|---|---|---|---|
| 458,014 | 8/1981 | Caswell | 239/519 |
| 824,453 | 6/1906 | Thompson | 169/41 |
| 1,309,146 | 7/1919 | Mann | 285/368 |
| 1,699,244 | 1/1929 | Lewis | 169/57 |
| 1,736,256 | 11/1929 | Doughty | 169/37 |
| 1,806,710 | 5/1931 | Ross, Jr. | 285/368 X |
| 1,898,482 | 2/1933 | Doughty | 169/57 X |
| 1,925,007 | 8/1933 | Rowley | 169/42 |
| 2,431,110 | 11/1947 | Clair | 169/42 X |
| 2,692,649 | 10/1954 | McCreary | 169/57 |
| 3,001,804 | 9/1961 | Tomlison et al. | 285/368 X |
| 3,139,103 | 6/1964 | Bottum | 169/42 X |
| 3,605,902 | 9/1971 | Ault | 169/42 X |
| 3,638,734 | 2/1972 | Ault | 169/42 X |
| 3,763,936 | 10/1973 | Menage | 169/56 X |
| 3,771,606 | 11/1973 | James | 169/37 |
| 3,800,878 | 4/1974 | Poitras | 169/57 X |
| 3,810,511 | 5/1974 | James | 169/42 X |
| 4,260,023 | 4/1981 | Irmscher | 169/57 |
| 4,519,458 | 5/1985 | Kroeter | 169/56 |
| 4,805,701 | 2/1989 | Mountford | 169/57 |

FOREIGN PATENT DOCUMENTS

| | | | |
|---|---|---|---|
| 138195 | 4/1985 | European Pat. Off. | 169/56 |
| 523513 | 4/1931 | Fed. Rep. of Germany | 169/54 |

*Primary Examiner*—Joseph F. Peters, Jr.
*Assistant Examiner*—James M. Kannofsky
*Attorney, Agent, or Firm*—Arne I. Fors

[57] ABSTRACT

A fire suppression system for use with ducts carrying corrosive gases has a multiplicity of sprinkler assemblies, each having an easily replaceable adapter with a sprinkler head having a fusible alloy fill. The head is screwed into one end of the adapter which has an integral flange at its opposite end. The adapter is inserted in a flanged nozzle which is part of the duct. The adapter flange is bolted to the nozzle flange which has a central opening adapted for connection to a source of extinguishing fluid. A continuous passage for fluid is provided through the adapter and the flanges together with a passage through the sprinkler head, the latter being opened when the system is activated. Only the face of the adapter and a small protruding portion of the sprinkler head are exposed to the corrosive gases. The sprinkler head has a corrosion-resistant body and has a central passage containing a seal plug and a fusible fill at opposite ends and a piston between the fill and the plug. Upon activation, the fill melts, and fluid pressure cleanly ejects both piston and plug from the passage in the spinkler head, thereby providing full bore for the passage of fluid. The piston insulates the fusible fill from any colling effect, and provides reliable operation with short response times.

6 Claims, 1 Drawing Sheet

SPRINKLER SYSTEM AND SPRINKLER ASSEMBLY THEREFOR

This invention relates to a sprinkler system and, more particularly to a sprinkler assembly of a sprinkler system for use with corrosive environments.

BACKGROUND OF THE INVENTION

In many systems for the suppression of fires, one or more sprinkler heads are connected to a piping system that, upon activation in response to raised temperatures, will emit fire extinguishing fluid. The sprinkler heads usually include a fusible or frangible element such as a plug, strut, gasket or ring to maintain the sprinkler head closed when inactive. Depending on the application and the environment, the fusible material is adapted to fuse at a predetermined temperature that can range from 50° C. to several hundred degrees Celcius.

The prior art is replete with references to sprinkler heads containing a fusible or frangible element. More specifically, a number of references disclose fusible plugs or sprinkler heads equipped with such plugs. In U.S. Pat. Nos. 1,736,256 and 1,898,482 are disclosed sprinkler heads that have a passage with grooves filled with a fusible material (wax, stearine or other organic compound) separated from the continuation of the passage through an outside-threaded portion of the head by a frangible diaphragm. In U.S. Pat. No. 1,925,007 a fusible plug is disclosed made of fusible alloy or solder. The fusible unit comprises a load-sustaining element and a protective envelope of a non-metallic fusible material. In U.S. Pat. No. 2,431,110 is disclosed a fusible core in the bore of a non-fusible, elongated, screw-threaded plug for boilers. In U.S. Pat. No. 3,139,103 is disclosed a fusible plug for a refrigeration system comprising a fusible alloy (melting point range 70°-190° C.), and a securing rivet inserted in the plug body to seal the opening. U.S. Pat. Nos. 3,605,902 and 3,638,734 relate to the use of a fusible alloy element having a plated coating, jacket or stretchable sleeve to prevent cold flow, the alloy being a Pb-Sn-Bi-Cd alloy melting at 74° C. U.S. Pat. Nos. 3,771,606 and 3,810,511 disclose sprinkler heads with a threaded nozzle aperture sealed with a fusible material for a fire extinguishing system that is charged with air and connected to a water supply system so that the sprinkler heads remain dry until the system is activated.

Most of these references disclose, in addition to the fusible element, means to retain the element in the plug on the sprinkler head, such as a frangible diaphragm, a protecting envelope, a sealing film, a rivet or reinforcing means. In some uses, the fusible element is not directly or has a limited area exposed to the atmosphere, while upon activation the retaining means may not provide free passage for the fluid. None of the sprinkler heads according to the prior art is useful in highly-corrosive environments, especially in those in which highly-corrosive gases are contained in ducts or pipes made of material such as fibreglass-reinforced plastic. Most prior art sprinkler heads have parts that would be prominently exposed to the corrosive substances.

SUMMARY OF THE INVENTION

We have now developed a sprinkler assembly as part of a fire suppression system for use with ducts carrying flows of highly-corrosive gases. The gases may contain particulates. The ducts have a multiplicity of integral spaced-apart nozzles each with an inserted adapter provided with a sprinkler head. Only the face of each adapter and the tip of the sprinkler head are exposed to the corrosive gases. The sprinkler head, which has a central fluid passage and a fusible fill, is threaded into one end of a central fluid passage in the adapter, which has an adapter flange at its opposite end. The adapter flange is clamped between a flange on the nozzle and a pipe flange with a central opening adapted for connection to a source of extinguishing fluid. The opening in the pipe flange forms a continuous passage for fluid with the central fluid passage in the adapter and the fluid passage in the sprinkler head. The sprinkler head consists of a corrosion-resistant body with an outside threaded portion adapted for screwing into the threaded end of the fluid passage in the adapter, a seal plug in the threaded portion, a low-melting bismuth-lead alloy fill secured in the opposite end, and a piston between the plug and the fusible fill. The small protruding section of the body and the fill in the sprinkler head provide full yet limited exposure to the flow of corrosive gases in the duct. Upon activation, the fusible fill melts, ,and fluid pressure ejects both plug and piston rapidly and completely from the sprinkler head, thereby providing full bore for the passage of fluid. The piston in the sprinkler head and the mass and material of the adapter protect the fusible fill from any cooling effect.

It is, therefore, an object of the present invention to provide a fire suppression system for ducts carrying flows of corrosive gases. It is another object to provide a sprinkler assembly for use with the system. It is still another object to provide a sprinkler head that has only a small part exposed to corrosive substances. It is a further object to provide a sprinkler head for use in a fire suppression system for ducts carrying flows of corrosive gases that has a short response time and wherein a fusible plug is protected from any cooling effect.

Accordingly, there is provided in a first embodiment a fire suppression system for ducts carrying flows of corrosive gases, said system comprising at least one fluid pipe for conducting extinguishing fluid, said ducts each having a wall with an inner wall surface and a multiplicity of nozzles mounted perpendicular to said wall with one end in said wall and spaced along the length of said ducts, said nozzles each having an nozzle flange at the other end; an adapter slideably inserted in each of said nozzles, said adapter having an adapter face at one end, an integral adapter flange at the opposite end and a central adapter passage having a threaded portion in proximity to said adapter face, said adapter face being substantially flush with said inner wall surface of said ducts; a pipe flange with a central opening connected to said fluid pipe; said integral adapter flange being rigidly clamped between said nozzle flange and said pipe flange; a sprinkler head screwed into said threaded portion of said central adapter passage such that a portion of said sprinkler head protrudes from said passage, the protruding portion being exposed to said flows of corrosive gases, said sprinkler head having a central sprinkler head passage containing a seal plug at one end, a fusible fill at the opposite end at said protruding portion and a piston between said seal plug and said fusible fill; said fluid pipe, said central adapter passage and said central sprinkler head passage forming a continuous clean passage for conducting extinguishing fluid when upon activation of said system by melting of said fusible fill, fluid pressure cleanly ejects said piston and said seal plug from said central sprinkler head passage; and said adapter and said piston forming an effective barrier against heat transfer and preventing any cooling effect to reach said fusible fill. According to a second embodiment, there is provided a sprinkler assembly for a fire suppression system and for use with corrosive gases flowing in a duct having a wall with an inner surface, said sprinkler assembly comprising an adapter having an adapter face at one end, an integral adapter flange at the opposite end and a central adapter passage; said adapter being slideably inserted in a nozzle integral with said duct and mounted perpendicularly to said wall with one end in the wall of said duct and having an integral nozzle flange at the other end, such that said adapter face is substantially flush with said inner wall surface of the duct; said central adapter passage in the adapter having a smaller diameter section in proximity to said adapter face, said smaller diameter section having a threaded portion adjacent said face, and having a larger diameter section at said opposite end having said integral adapter flange; a pipe flange with a central opening adapted for attachment to a fluid pipe for conducting extinguishing fluid; said adapter flange being rigidly clamped between said pipe flange and said nozzle flange; a sprinkler head screwed into the threaded portion of said smaller diameter section of said central adapter passage, said sprinkler head having a sprinkler head body with a central sprinkler head passage, an outside-threaded portion for attachment of said sprinkler head into said adapter, and a non-threaded portion, said non-threaded portion of said sprinkler head protruding into the flow of corrosive gases in said duct; said central sprinkler head passage containing a seal plug at the end having said threaded portion, a fusible fill at the end of said non-threaded portion and a piston between said seal plug and said fusible fill.

Preferably, the central sprinkler head passage in the sprinkler head has a cylindrical portion, a shoulder and a shoulder portion, said shoulder portion having an inside circumferential groove of a substantial V-shape with an angle of about 60°, the diameter of said shoulder portion being larger than the diameter of said cylindrical portion, said seal plug being adapted to fittingly insert in said passage, said fusible fill filling said shoulder portion and said groove, and said piston loosely fitting in said passage between said seal plug and said fusible fill.

BRIEF DESCRIPTION OF DRAWINGS

The invention will now be described in detail with reference to the accompanying drawings wherein.

DETAILED DESCRIPTION

In many industrial installations, highly-corrosive and erosive substances are transferred in pipes and ducts between operations. The nature of the substances requires that those pipes and ducts are made of corrosion-resistant materials, and in many cases such materials are plastics such as fibreglass-reinforced resins. In order to obtain insurance coverage for the operations, fire suppression systems are required that can satisfactorily operate and protect the installations and personnel.

The present invention relates to such a system wherein the piping carrying an extinguishing fluid (water) are external to ducts or pipes carrying highly-corrosive gases including particulate-laden gases. The ducts have at least one, usually a multiplicity, of sprinkler assemblies each consisting of integral flanged nozzles mounted perpendicularly to and in the wall of the ducts in spaced relation, the spacing depending on the diameter of the duct. Each nozzle contains an adapter with a sprinkler head. An adapter is connected to the flange on the nozzle and to a pipe flange on a fluid pipe of the fire suppression system. The system comprises at least one fluid pipe for conducting extinguishing fluid, each pipe connected to a sprinkler assembly.

The face of the adapter is substantially flush with the inner wall surface of the duct. The adapter has a central passage for fluid and a sprinkler head with a fusible fill mounted in the end of the passage, such that only a small section of the head and the fusible fill are exposed to the corrosive substances in the duct.

Figure 1:
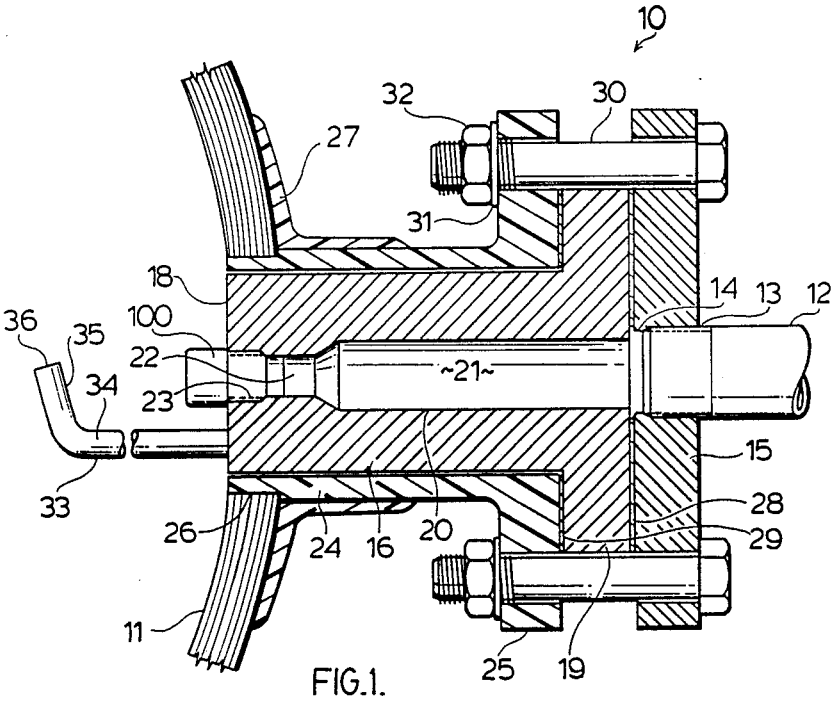
FIG. 1 is a section through the sprinkler assembly attached to a duct.

With reference now to FIG. 1, the sprinkler assembly generally indicated with 10, is attached perpendicularly to a duct 11 (shown in part) carrying flows of highly-corrosive gases, that may also contain particulates, such as, for example, encountered in gas handling systems of metallurgical operations treating sulfide-containing materials. Sprinkler assembly 10 is connected to a fluid pipe 12 conducting extinguishing fluid external to duct 11. Fluid pipe 12 has a threaded end 13 with which it is screwed into a threaded opening 14 central in a pipe flange 15. Sprinkler assembly 10 consists of a generally cylindrical adapter 16 that has an adapter face 18 at one end, an integral adapter flange 19 at the opposite end and a central adapter passage 20. Central adapter passage 20 has a larger diameter section 21 at the flange side and a short smaller diameter section 22 at the side of face 18. The larger diameter section 21 has a diameter equal to the inside diameter of the fluid pipe 12. Adapter flange 19 is positioned adjacent pipe flange 15. The short narrower diameter section 22 of central adapter passage 20 has a threaded portion 23 in proximity to adapter face 18 and adapted to contain sprinkler head 100, to be described. The adapter 16 is inserted in a nozzle 24 having a nozzle flange 25 at one end and a shoulder portion 26 at the other end. The nozzle 24 is fixedly attached at its shoulder portion 26 in an opening in the side of and in perpendicular direction to duct 11. The area of insertion on the duct and of the nozzle is secured with a lay-up 27, to be defined. Adapter 16 slideably fits into nozzle 24 providing for easy insertion.

The sprinkler assembly is attached to the duct in a gas-tight manner by rigidly clamping adapter flange 19 between pipe flange 15 and nozzle flange 25 with intermediate gaskets 28 and 29. Clamping is done by means of four bolts 30 (two are shown), each with a washer 31 and a nut 32. Bolts 30 pass through corresponding apertures in the peripheral areas of flanges 15 and 25. The diameter of adapter flange 19 is such that flange 19 fits between the bolts 30.

An easily replaceable spray deflector rod 33 is screwed into the adapter face 18 of adapter 16. Rod 33 has a straight section 34 and a bent section 35 with distal end 36, and is positioned such that distal end 36 is in front of and will be hit by fluid emitting from sprinkler head 100.

Figure 2:
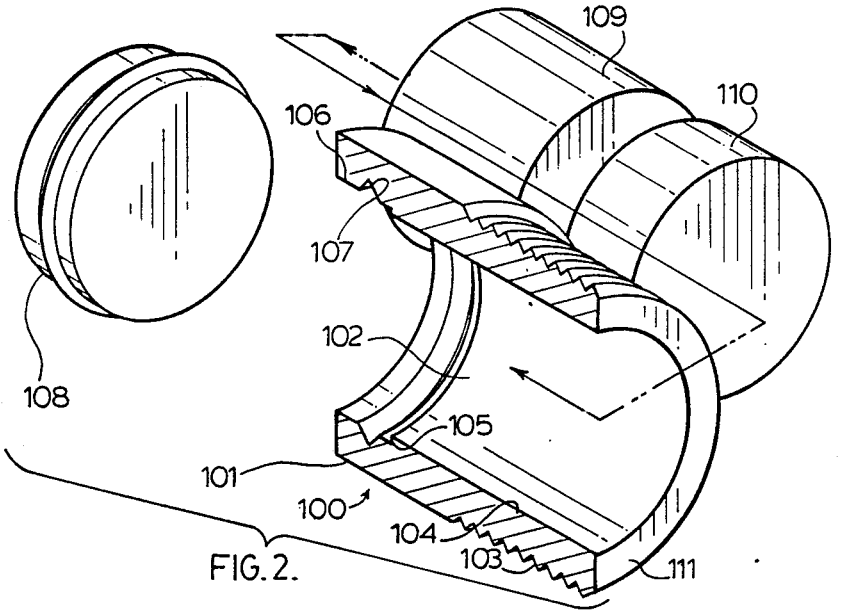
FIG. 2 is a an exploded view of the sprinkler head.

With reference to FIG. 2, the sprinkler head, generally indicated with 100, has a generally cylindrical sprinkler head body 101 with a central sprinkler head passage 102. Body 101 has an outside threaded, slightly tapered portion 103 with which sprinkler head 100 is securely screwed into threaded portion 23 of central adapter passage 20 in adapter 16, such that the non-threaded portion of sprinkler head 100 protrudes beyond adapter face 18.

Central sprinkler head passage 102 in sprinkler head 100 has a cylindrical portion 104 and a shoulder 105 demarcating a sprinkler head shoulder portion 106 with a slightly larger diameter than cylindrical portion 104. Shoulder portion 106 has an inside circumferential groove 107. Groove 107 has a substantial V-shape with an angle of, preferably, about 60°. The length of shoulder portion 106 is sufficient to accomodate a fusible fill 108 made of a fusible alloy of a thickness that is adequate to provide the required strength against pressure exerted by the fluid in pipe 12.

In addition to fusible fill 108, cylindrical portion 104 of central passage 102 accomodates a piston 109 and a seal plug 110. The seal plug 110 fittingly inserts in the end 111 of sprinkler head 100. The piston 109 fits loosely in central passage 102 from shoulder 105 to plug 110 and between fill 108 and seal plug 110. When installed in the adapter, the piston 109 extends past the adapter face 18 of and into the adapter 16. The replaceable sprinkler heads 100 are readily made by forming a unitary fusible fill 108 to shoulder 105 in shoulder portion 106 and groove 107, sliding piston 109 into passage 102 against fill 108 and fittingly inserting seal plug 110 in end 111 of passage 102 of sprinkler head body 101.

The materials from which the sprinkler assembly is made should generally be corrosion-resistant as well as erosion-resistant in environments that contain flows of acidic gases and solids. For a sprinkler system including sprinkler assemblies according to the invention, the fluid pipe 12 and pipe flange 15 may be made of mild steel, and the bolts 30, washers 31 and nuts 32 of stainless steel. Adapter 16 and spray deflector rod 33 are preferably made of ultra-high molecular weight polyethylene. The nozzle 24 is preferably made of fibreglass-reinforced polyester resin, the exposed edges being resin-sealed. The lay up 27 on duct 11 and around sleeve 24 consists of fibreglass-reinforced polyester comprising layers of mat, roving and resin (for example, Hetron TM 197-P resin with UV stabilizer). Gaskets 28 and 29 are preferably made of closed-cell foam epichlorohydrin. The sprinkler head 100 has a body 101 of lead-antimony alloy, a silicone rubber seal plug 110 and a Teflon TM piston 109. The fusible fill 108 is made of a bismuth alloy containing 50% bismuth, 26.7% lead, 13.3% tin and 10% cadmium, and having a melting point of 70° C.

In the operation of the sprinkler assembly, air under pressure fills the at least one fluid pipe of the dry sprinkler system, and fills the central passage 20 in each of the adapters up against the seal plug 110 of the sprinkler head 100. When temperatures higher than the melting point of the fusible fill 108 cause melting of the fill, pressure exerted by the air causes the seal plug 110 and piston 109 to be ejected from the sprinkler head, thereby cleaning out passage 102 in sprinkler head 100. The escaping air causes pressure to drop which activates a source of pressurized water, and water rapidly fills the pipe 12 and emits from the sprinkler head 100 to be broken up into a spray against the end 36 of deflector rod 33. After operation is finished, the adapter 16 is removed from each location, the sprinkler head 100 is replaced and the adapter is re-installed. The adapter 16 provides and has a mass sufficient to provide an effective barrier against heat transfer between material in duct 11 and the nozzle 24 and the sprinkler system piping, including fluid pipe 12. The loosely-fitting piston 109 in the sprinkler head 100 assures cleaning of and providing full bore through the sprinkler head when ejected by air pressure after the fusible fill 108 has melted. The piston 109 of sprinkler head 100 extends past adapter face 18 of adapter 16, and is long enough to act as an insulator and to prevent any cooling effect to reach fusible fill 108. The seal plug 110 provides a barrier to fluid reaching the fusible fill 108 until the system is activated, i.e., the fill has melted. The seal plug 110 fittingly inserted in sprinkler head 100 not only seals but is also readily pushed out of the sprinkler head by normally-used air pressure.

Sprinkler assemblies, constructed as described and made of the preferred materials, were installed as part of a dry system in small and large ducts for conveying moist, sulfur dioxide- and solids-containing gases in a large metallurgical operation. The adapter 16 of each sprinkler assembly 10 has a length of 152.4 mm (6 inch) and a diameter of 71.44 mm (2 13/16 inch). The larger diameter section 21 of central passage 20 through adapter 16 has a diameter of 25.4 mm (1 inch). The central insert passage 102 through the sprinkler head 100 has a diameter of 11.7 mm (0.46 inch) and the fusible fill 108 is 4.76 mm (3/16 inch) thick and has a diameter of 14.3 mm (9/16 inch). Groove 107 has a 60° angle and a depth of 1.2 mm (3/64 inch). The sprinkler head 100 is screwed into a 76.2 mm (3 inch) diameter adapter 16 (NPT thread and thread-sealing compound) with a torque of 5.65 Nm (50 inch-pounds). This torque provides a tight fit, and does not cause deformation of the sprinkler head. The sprinkler head 100 is 30.2 mm (1 3/16 inch) long. The seal plug is 6.35 mm (¼ inch) long and the piston is 19 mm (¾ inch) long. Fluid pipe 12 is filled with air under 375 kPa (40 psig) pressure. The response time of the sprinkler head is 120 to 150 seconds.

It is noted that several commercially available sprinkler heads were tested in the same environment and all failed after a short period due to corrosion and erosion.

We claim:

1. A fire suppression system for ducts carrying flows of corrosive gases, said system comprising at least one pipe for conducting extinguishing fluid, said ducts each having a wall with an inner wall surface and at least one nozzle mounted perpendicularly to said wall with one end in said wall, said at least one nozzle having an integral nozzle flange at the other end; an adapter slideably inserted in said at least one nozzle, said adapter having an adapter face at one end, an integral adapter flange at the opposite end and a central adapter passage having a threaded portion in proximity to said adapter face, said adapter face being substantially flush with said inner wall surface of said ducts; a pipe flange with a central opening connected to said at least one fluid pipe; said integral adapter flange being rigidly clamped between said nozzle flange and said pipe flange; a sprinkler head screwed into said threaded portion of said central adapter passage such that a portion of said sprinkler head protrudes from said passage, the protruding portion being exposed to said flows of corrosive gases, said sprinkler head having a central sprinkler head passage containing a seal plug at one end, a fusible fill at the opposite end at said protruding portion and a piston between said seal plug and said fusible fill; said at least one fluid pipe, said central adapter passage and said central sprinkler head passage forming a continuous clean passage for conducting extinguishing fluid when upon activation of said system by melting of said fusible fill, fluid pressure cleanly ejects said piston and said seal plug from said central sprinkler head passage; and said adapter and said piston forming an effective barrier against heat transfer and preventing any cooling effect to reach said fusible fill.

2. A fire suppression system as claimed in claim 1, wherein said central sprinkler head passage in said sprinkler head has a cylindrical portion, a shoulder and a shoulder portion, said shoulder portion having an inside circumferential groove of a substantial V-shape with an angle of about 60°, the diameter of said shoulder portion being larger than the diameter of said cylindrical portion, said seal plug being adapted to be fittingly inserted in said passage, said fusible fill filling said shoulder portion and said groove, and said piston loosely fitting in said passage between said seal plug and said fusible fill.

3. A fire suppression system as claimed in claim 1, wherein said adapter face of said adapter has a spray deflector rod screwed therein, said rod having a bent section with a distal end, said rod being screwed into said adapter face such that the distal end is in front of said sprinkler head.

4. A sprinkler assembly for a fire suppression system and for use with corrosive gases flowing in a duct having a wall with an inner surface, said sprinkler assembly comprising an adapter having an adapter face at one end, an integral adapter flange at the opposite end and a central adapter passage; said adapter being slideably inserted in a nozzle integral with said duct and mounted perpendicularly to said wall with one end in the wall of said duct and having an integral nozzle flange at the other end, such that said adapter face is substantially flush with said inner wall surface of the duct; said central adapter passage in the adapter having a smaller diameter section in proximity to said adapter face, said smaller diameter section having a threaded portion adjacent said face, and having a larger diameter section at said opposite end having said integral adapter flange; a pipe flange with a central opening adapted for attachment to a fluid pipe for conducting extinguishing fluid; said adapter flange being rigidly clamped between said pipe flange and said nozzle flange; a sprinkler head screwed into the threaded portion of said smaller diameter section of said central adapter passage, said sprinkler head having a sprinkler head body with a central sprinkler head passage, an outside-threaded portion for attachment of said sprinkler head into said adapter, and a non-threaded portion, said non-threaded portion of said sprinkler head protruding into the flow of corrosive gases in said duct; said central sprinkler head passage containing a seal plug at the end having said threaded portion, a fusible fill at the end of said non-threaded portion and a piston between said seal plug and said fusible fill.

5. A sprinkler assembly as claimed in claim 4, wherein said central sprinkler head passage in said sprinkler head has a cylindrical portion, a shoulder and a shoulder portion, said shoulder portion having an inside circumferential groove of a substantial V-shape with an angle of about 60°, the diameter of said shoulder portion being larger than the diameter of said cylindrical portion, said seal plug being adapted to be fittingly inserted in said passage, said fusible fill filling said shoulder portion and said groove, and said piston loosely fitting in said passage between said seal plug and said fusible fill.

6. A sprinkler assembly as claimed in claim 4, wherein said adapter face of said adapter has a spray deflector rod screwed therein, said rod having a bent section with a distal end, said rod being screwed into said adapter face such that the distal end is in front of said sprinkler head.

* * * * *